United States Patent [19]

Gauvain et al.

[11] 4,392,276

[45] Jul. 12, 1983

[54] FIBER SEPARATOR FOR FEEDING A FREED-FIBER SPINNING UNIT

[75] Inventors: Roger Gauvain, Buhl; Michel Kueny, Brunstatt, both of France

[73] Assignee: Societe Alsacienne de Constructions Mecaniques de Mulhouse, Mulhouse, France

[21] Appl. No.: 249,988

[22] Filed: Apr. 1, 1981

[30] Foreign Application Priority Data

Apr. 4, 1980 [FR] France ..... 80 07652

[51] Int. Cl.[3] ..... D01H 1/12; D01G 19/10; D01G 15/14

[52] U.S. Cl. ..... 19/97; 19/112

[58] Field of Search ..... 19/97, 112; 29/121.4; 57/58.93

[56] References Cited

U.S. PATENT DOCUMENTS

| | | | |
|---|---|---|---|
| 866,918 | 9/1907 | Collins | 19/97 |
| 896,437 | 8/1908 | Collins | 19/97 X |
| 3,968,542 | 7/1976 | Hollingsworth | 19/97 |
| 4,291,437 | 9/1981 | Yoshizawa et al. | 19/97 X |
| 4,300,265 | 11/1981 | Heinen | 19/97 X |

FOREIGN PATENT DOCUMENTS

| | | | |
|---|---|---|---|
| 1036725 | 8/1958 | Fed. Rep. of Germany | 19/97 |
| 2419340 | 10/1979 | Fed. Rep. of Germany | 19/97 |
| 2277914 | 12/1976 | France . | |

*Primary Examiner*—Louis Rimrodt

*Attorney, Agent, or Firm*—McDougall, Hersh & Scott

[57] ABSTRACT

The device for separating individual fibers of a fiber sliver comprises sliver feed rollers, sliver opening means comprising a press roller and a separating roller adapted to carry a stack of thin disks provided with combing elements which consist of teeth or wire points for separating the fibers and with drafting elements for parallelizing the fibers, and a duct for the delivery of freed fibers. The separator can be employed for spinning slivers containing either long or short fibers or a mixture of both.

11 Claims, 7 Drawing Figures

FIG. 4
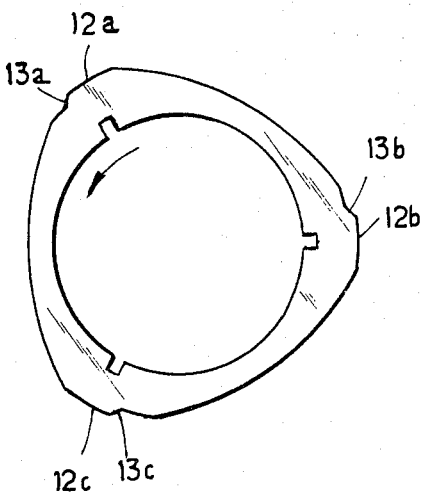
FIG 5
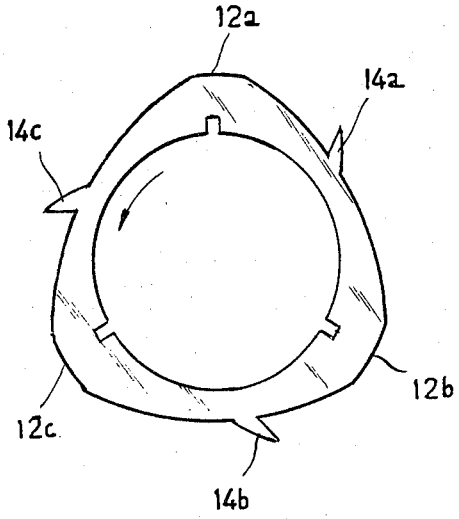
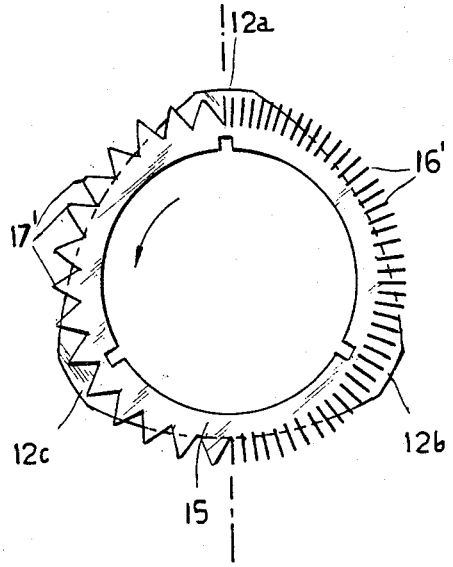
FIG. 6
FIG. 7
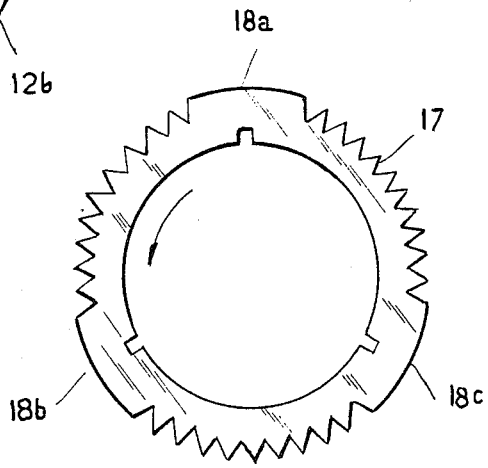

FIBER SEPARATOR FOR FEEDING A FREED-FIBER SPINNING UNIT

This invention relates to the textile industry and more particularly to spinning by the so-called "freed fiber" process.

In this method of spinning, the fibers of a sliver delivered by a preparation machine are individualized, then transferred to a device which condenses them so as to form a continuous thread which is wound onto a bobbin support.

Separation of sliver into its individual fibers is usually performed either by means of a fiber-opener or by means of a selector.

The fiber-opener is essentially constituted by a metallic band provided with teeth somewhat comparable to card clothing, the band being wound helically on a cylinder which rotates about its axis. The teeth comb the sliver and separate the fibers which are driven by an airstream to the spinning unit.

This device produces excellent results when working on short fibers but damages long fibers which are very often broken. Furthermore, long fibers have a tendency to wind within the grooves located between the turns of the helix formed by the wire clothing and rapidly cause clogging of the fiber-opener. It is necessary in that case to stop the spinning unit and to clean the fiber-opener, which is not always an easy operation.

On the contrary, the selector is specifically employed for processing long fibers and also has the general shape of a cylinder which rotates about its axis. However, the selector usually consists of a stack of disks, certain portions of which have been recessed whilst the remaining portions of the external circumference of two consecutive disks are angularly displaced with respect to each other. Said disks are separated by grooves of relatively small depth. The selector is always accompanied by a press roller with which it acts as a drawing device having a high degree of draft and those portions of the external circumference of the disks which act as drafting bands are adapted to cooperate with the press roller. A selector of this type has been described in French Pat. No. 2,277,914 filed on July 9th, 1974 in the name of the present Applicant.

By reason of the high speed of rotation of the selector, excess pressure is developed at the level of the drafting bands, thus resulting in lateral scattering and even loss of fibers if they are too short. This drawback can be overcome to a certain extent by making provision upstream of the selector for a pre-drawing zone which already secures parallelization of the feed sliver fibers.

However, in order to increase the production of spinning machines and to reduce operating costs, it would be highly desirable to spin fibers obtained directly from the card slivers, if possible by dispensing with the pre-drawing operation or at least by reducing the number of pre-drawing passes.

The aim of the invention is to provide a device which has the design function of separating the fibers of a card sliver and which operates under the conditions mentioned in the foregoing, said device being capable of spinning long fibers as well as short fibers and especially a mixture of both.

The device in accordance with the invention for separating the fibers of a card sliver essentially comprises both combing elements which serve to separate the fibers and drafting elements which parallelize the fibers.

These and other features of the invention will be more apparent upon consideration of the following description and accompanying drawings, wherein:

FIGS. 2 to 5 show different modifications of selector blades for adapting these latter to the requirements of the invention;

FIG. 6 illustrates a wire-point disk in the right half of the figure whereas the left half shows a toothed disk interposed between two selector blades;

FIG. 7 illustrates a fiber-opener which has been modified in accordance with the invention.

Figure 1:
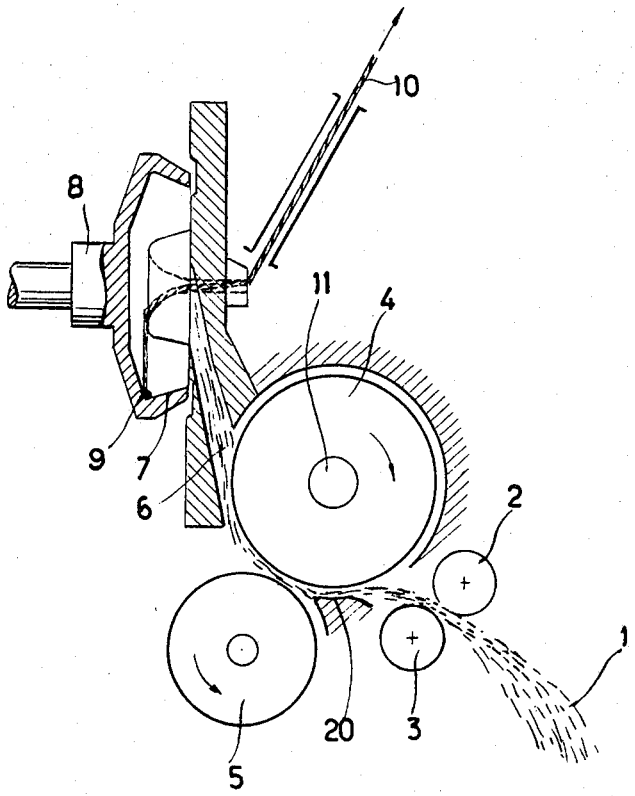
FIG. 1 is a highly diagrammatic general view of a spinning unit equipped with a device in accordance with the invention.

The freed-fiber spinning unit shown in FIG. 1 essentially comprises a reserve (not shown) of fiber sliver 1. The sliver is conveyed by means of two feed rollers 2, 3 or by any other conventional feeding means to a separating device 4 which forms the main object of the invention and will be described hereinafter in detail. The design function of the device is to divide the sliver 1 into its elementary fibers and is accordingly adapted to cooperate with a press roller 5 in order to separate the individual fibers which are conveyed by means of an airstream produced in any known manner and passed through the duct 6 onto the sliding surface 7 of a spinning rotor 8. Said fibers are united within the channel 9 so as to form a thread 10 which is drawn and wound on a bobbin by any known means.

The spinning rotor 8 may be replaced by any system for producing a thread from freed fibers, such as friction systems, pneumatic or electrostatic systems, without thereby departing from the scope of the invention.

In a first embodiment of the invention, the device 4 is designed in much the same manner as a selector and consists of a stack of blades on a shaft 11 on which the blade assembly is rotatably mounted. By way of example, said blades can have one of the shapes shown in FIGS. 2 to 5. The blades have a common general shape insofar as they are all derived from a circle in which there still remain a certain number of arcs of the external circumference, namely three arcs **12*a*, 12*b*, 12*c*** in the designs illustrated. These arcs of circumference constitute drafting elements or "bands". Within the stack of disks, said arcs are relatively displaced over a predetermined angular distance in such a manner as to ensure that one generator-line of the cylinder always intersects at least two of said arcs.

Figure 2:
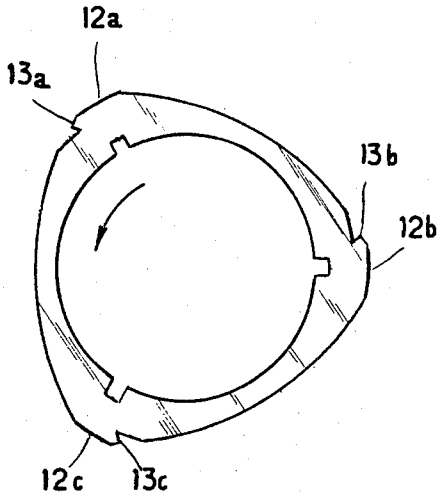
Figure 3:
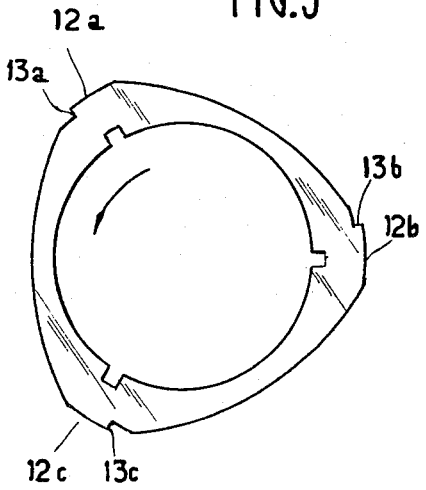

The blade shown in FIG. 2 has positive teeth **13*a*, 13*b* and 13*c* on the edge of each circular arc 12*a*, 12*b* and 12*c* which produces a drafting action on the sliver of fibers 1 when the device rotates in the direction indicated by the arrow in FIG. 1. FIGS. 3 and 4 also show blades provided with teeth 13*a*, 13*b* and 13*c* on the leading edge of the drafting bands 12*a*, 12*b* and 12*c*. In FIG. 3, however, said teeth have rectangular sides whereas FIG. 4** shows negative teeth.

Irrespective of the shape of the teeth 13, the operation of the device is the same in its general principle. The sliver 1 is conveyed by means of the two rubber-covered rollers 2 and 3, not to the vicinity of the point of contact of the device 4 with the press roller 5 as is the case when working with a conventional selector, but to a position located substantially upstream with respect to the direction of rotation of the roller 4 (as shown in FIG. 1). Throughout the zone 20 located between the sliver feed point and the point at which the roller 4 is applied in contact with the press roller 5, the device 4 operates in the same manner as a fiber-opener. The teeth 13 which constitute the combing elements have the intended function of combing the sliver 1 and separating individual fibers. But as soon as the fibers reach the point of contact with the press roller, they are engaged by the drafting bands 12. Thus the long fibers do not have time to be broken as a result of a combing operation as would be liable to occur if said operation were to continue up to the inlet of the duct 6. Furthermore, the fibers are transferred as soon as they have been freed by the drafting bands, thus preventing them from carrying out several revolutions and thus clogging the separator 4.

FIG. 5 shows an alternative embodiment in accordance with the invention.

In the stack of blades which constitutes the separating device 4, each blade is provided with teeth or wire points 14 placed substantially at the center of the outer edge of the hollowed-out portion of the disks which constitute the blades. Said blades are stacked in such a manner as to ensure that the teeth are relatively displaced at a constant angular interval.

The operation is exactly the same as that of the embodiment described earlier. In the zone 20 located between the point of feeding of the fibers and the point of contact of the press cylinder, the teeth comb the sliver 1 and separate the fibers which are taken by the drafting bands 12 immediately at the point of contact of the press roller.

FIG. 6 shows yet another alternative embodiment in accordance with the invention. The separator 4 is constituted by a stack which is made up alternately of a normal selector disk and of a disk 15 having wire points 16' or teeth 17'. The overall diameter of the last-mentioned disk is so determined that the wire points or the teeth are set back by a few tenths of a millimeter with respect to the portions 12 of the selector blades but project beyond the hollowed-out portions of said blades. The mode of operation is again identical with that of the devices described in the foregoing: the wire points 16' or teeth 17' perform the function of a fiber-opener, particularly between feeding of the sliver 1 and the point of contact of the press roller 5, whereupon the smooth disks perform a selector function. The disks 15 can carry either straight or inclined wire points 16' or else either positive or negative teeth 17'.

The different embodiments mentioned earlier are more particularly derived from the fiber selector. The alternative embodiment shown diagrammatically in FIG. 7 is derived from the fiber-opener. In fact, this embodiment consists of a fiber-opener covering in which are formed spaces 18 without teeth. These smooth portions are such that they partially overlap on two consecutive turns of the helix on which the covering is wound around the roller. The smooth portions 18 are so designed that their outer edges project slightly above the height of the teeth 17. The mode of operation adopted in this case is the same as before: the teeth perform a fiber-opening function and the smooth portions perform a selecting function.

The use of a fiber separator in accordance with the invention has made it possible to obtain threads of good quality with materials which it had proved impossible up to the present time to process on freed-fiber machines. For example, a linen card sliver consists of a mixture of fibers having different lengths and degrees of fineness. Spinning could not satisfactorily be performed either with a fiber-opener or with a selector. By making use of a separator according to the embodiment of FIG. 4, a yarn of good quality has been obtained.

It is also very difficult in the case of known separators to make profitable use of a mixture of waste products of wool consisting of very short fibers and of polyester consisting of long fibers. By means of a device according to the invention, a yarn of very satisfactory quality can be obtained from waste of this type.

What is claimed is:

1. A device for separating individual fibers of a sliver, comprising:

means for feeding the sliver;

means adjacent said feeding means for opening the sliver, comprising a combing and drafting cylinder, said combing and drafting cylinder being constituted by a shaft having a stack of disks mounted thereon, the edges of said disks having teeth or needles for combing the sliver and smooth portions on the periphery thereof for drafting the sliver, said disks being relatively angularly offset from one another, a pressure roller in close proximity to said combing and drafting cylinder;

a guiding means mounted between said feeding means and said combing and drafting cylinder; and fiber discharging duct means positioned downstream of said opening means.

2. A device according to claim 1, wherein the combing teeth are positive teeth.

3. A device according to claim 1, wherein the combing teeth are constituted by recesses having rectangular edges.

4. A device according to claim 1, wherein the combing teeth are negative teeth.

5. A device according to claim 1, wherein the combing elements are teeth or wire points located substantially at the mid-distance between two drafting elements.

6. A device according to claim 1, wherein the combing teeth or wire points are slightly set back with respect to the drafting elements.

7. A device according to claim 1, wherein the combing elements are sets of teeth arranged in alternate relation with the drafting elements on the same support.

8. A device according to claim 7, wherein the sets of teeth are slightly set back with respect to the drafting elements.

9. A device according to claim 1, wherein each disk carries both combing elements and drafting elements.

10. A device according to claim 1, wherein a certain number of disks carry only combing elements and that other disks carry only drafting elements.

11. A device according to claim 10, wherein the combing teeth or wire points are slightly set back with respect to the drafting elements.

* * * * *